US006698043B2

(12) United States Patent
Fabian

(10) Patent No.: US 6,698,043 B2
(45) Date of Patent: Mar. 2, 2004

(54) SPLIT SHEET/BEDSPREAD/COMFORTER

(76) Inventor: David W. Fabian, 1117 Maple St. Ext., Coraopolis, PA (US) 15108

( * ) Notice: Subject to any disclaimer, the term of this patent is extended or adjusted under 35 U.S.C. 154(b) by 0 days.

(21) Appl. No.: 10/034,731

(22) Filed: Dec. 28, 2001

(65) Prior Publication Data

US 2003/0121100 A1 Jul. 3, 2003

(51) Int. Cl.[7] ..... A47G 9/02
(52) U.S. Cl. ..... 5/486; 5/482
(58) Field of Search ..... 5/486, 482, 495, 5/496, 502, 923

(56) References Cited

U.S. PATENT DOCUMENTS

| | | | | | |
|---|---|---|---|---|---|
| 1,267,042 | A | * | 5/1918 | Arnold | 5/486 |
| 1,885,558 | A | * | 11/1932 | Smith | 128/872 |
| 2,689,961 | A | * | 9/1954 | Lieberthal | 5/486 |
| 2,730,728 | A | * | 1/1956 | Roberts | 5/486 |
| 3,072,776 | A | * | 1/1963 | Quenneville | 5/486 X |
| 3,331,088 | A | * | 7/1967 | Marquette | 5/486 X |
| 3,508,284 | A | * | 4/1970 | Marquette | 5/486 |
| 3,530,516 | A | * | 9/1970 | Marquette | 5/486 |
| 4,005,499 | A | * | 2/1977 | Klein | 5/486 |
| 4,069,526 | A | * | 1/1978 | Deikel | 5/486 |
| 4,573,227 | A | * | 3/1986 | Prandina | 5/486 |
| 4,802,251 | A | * | 2/1989 | O'Dell | 5/502 |
| 5,023,969 | A | * | 6/1991 | Nattrass | 5/486 |
| 5,201,086 | A | * | 4/1993 | Decker et al. | 5/669 |
| 5,287,573 | A | * | 2/1994 | Ritacco | 5/486 |
| 5,943,717 | A | * | 8/1999 | Alexander | 5/486 |
| 6,226,814 | B1 | * | 5/2001 | Alexander | 5/486 |
| 6,311,347 | B1 | * | 11/2001 | Limardi et al. | 5/486 |
| 6,341,396 | B1 | * | 1/2002 | Carapezza | 5/482 |
| 2003/0121100 | A1 | * | 7/2003 | Fabian | 5/486 |

FOREIGN PATENT DOCUMENTS

| | | | | |
|---|---|---|---|---|
| FR | 2569096 | * | 2/1986 | 5/486 |

* cited by examiner

*Primary Examiner*—Robert G. Santos
(74) *Attorney, Agent, or Firm*—James Ray & Associates

(57) ABSTRACT

A split bed covering is provided for more than one user which is capable of providing different warmth characteristics to each of the users. The covering comprises a first sheet having a top portion, a bottom portion, and an inner edge portion. The covering also includes a second sheet having a top portion, a bottom portion, and an inner edge portion. An overlapping portion is formed by the inner edge portions of the first and second sheets. These inner edge portions are capable of being interchangeably positioned one on top of the other. A joining device is provided for joining the overlapping portions at the bottom portion of the first sheet and the bottom portion of the second sheet to form a joined portion. This joined portion has a predetermined length which allows for complete removal of one of the first and/or second sheets from at least one of the users.

19 Claims, 1 Drawing Sheet

SPLIT SHEET/BEDSPREAD/COMFORTER

FIELD OF THE INVENTION

This invention relates to a bed covering for more than one user and more particularly to a bed covering capable of providing different warmth characteristics to the users.

BACKGROUND OF THE INVENTION

One of the problems with sharing a bed with another person is that the two people seldom desire the same warmth characteristics. Oftentimes there is a subconscious battle over the amount of coverage by the bed covering, or "blanket snatching", as one or both people desire more or less warmth during sleeping.

Many attempts and/or designs have been provided to try and overcome this problem. For example, dual controlled electric blankets are well known in the art, which allow for the users to adjust the amount of heating of their blanket on their side of the bed. However, these blankets can be quite costly and do not allow for one of the users to rapidly cool down should they become too hot during the night.

U.S. Pat. No. 2,730,728 to Roberts, U.S. Pat. No. 3,072,776 to Quenneville, and U.S. Pat. No. 6,226,814 to Alexander are directed to bed coverings which are split partway down the a center portion to allow one of the users to remove a portion of the covering from their body during the night should they become overheated. However, each of these previously patented coverings have several disadvantages. For example, each of these coverings require complicated connecting means for the joining the two halves of the sheets. Thus, should one become overheated during the night, they would have to completely wake up in order to unfasten the connecting means and possibly disturb the other user. Also, the coverings disclosed in these patents do not allow for such covering to be completely removed, such as at the feet portion, from one or both of the users. Furthermore, since the coverings are not split the entire length of the bed, the users are not able readily adjust the amount of overlap or coverage thereof without disturbing the other user. Note specifically the patent to Roberts which does not allow for a sufficient amount of overlap of the two halves to ensure sufficient coverage of the users. The coverings in the patents to Quenneville and Alexander are designed so that only one of the users may remove a portion of their covering without disturbing the other user.

Thus, there is a need in the art for a bed covering which allows for different warmth characteristics for the users, including complete removal of the covering therefrom, and which coverage may readily be adjusted for one or both of the users during the night without disturbance to the other user.

OBJECTS OF THE INVENTION

An object of the invention is to provide a bed covering which is split so as to allow the users in the bed to have their own amount of covering or level of warmth available when desired.

Another object of the invention is to provide a split bed covering which has a sufficient amount of overlap so that each user has enough covering during shifting throughout the night.

Yet another object of the invention is to provide a split bed covering which is split the entire length of the top portion of the mattress so that a user may readily adjust the amount of overlap by grasping a top portion of the covering and moving it closer or farther away from the edge of a mattress.

A further object of the invention is to provide a split bed covering which allows for complete removal of the covering from one or both occupants, including the feet portion of the users.

Yet another object of the invention is to provide a split bed covering which may be adjusted during the night without disturbance to the other user.

In addition to the objectives and advantages listed above, various other objectives and advantages of the split bed covering disclosed herein will become more readily apparent to persons skilled in the relevant art from a reading of the detailed description section of this document. The other objective and advantages will become particularly apparent when the detailed description is considered along with the drawing and claims presented herein.

SUMMARY OF THE INVENTION

Briefly, and in accordance with the forgoing objects a split bed covering is provided for more than one user which is capable of providing different warmth characteristics to each of the users. The covering comprises a first sheet having a top portion, a bottom portion, and an inner edge portion. The covering also includes a second sheet having a top portion, a bottom portion, and an inner edge portion. An overlapping portion is formed by the inner edge portions of the first and second sheets. These inner edge portions are capable of being interchangeably positioned one on top of the other. A joining means is provided for joining the overlapping portions at the bottom portion of the first sheet and the bottom portion of the second sheet to form a joined portion. This joined portion has a predetermined length which allows for complete removal of one of the first and/or second sheets from at least one of the users.

DETAILED DESCRIPTION OF THE INVENTION

Figure 1:
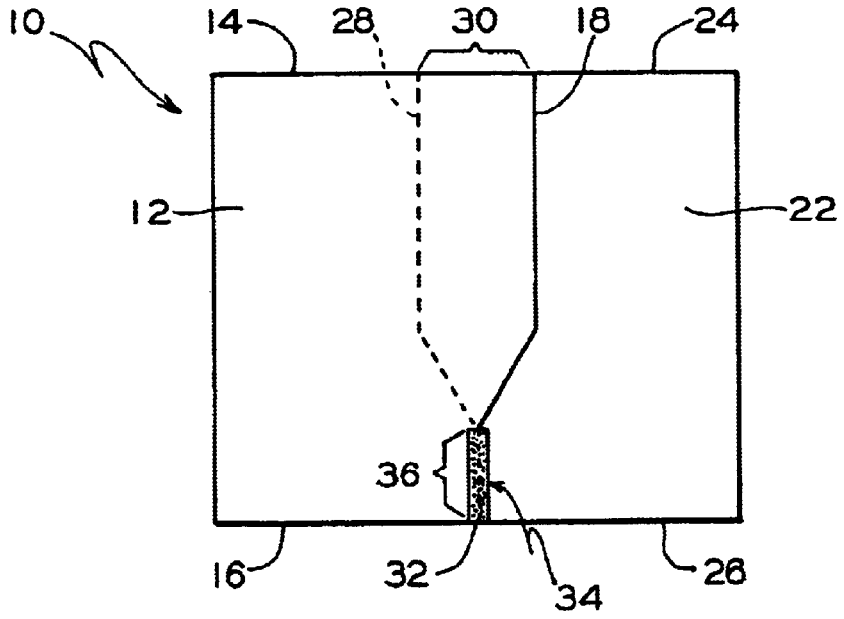
FIG. 1 shows a plan view of the split bed covering of the invention.

Before describing the invention in detail, the reader is advised that, for the sake of clarity and understanding, identical components having identical functions have been marked where possible with the same reference numerals in each of the Figures provided in this document.

Figure 2:
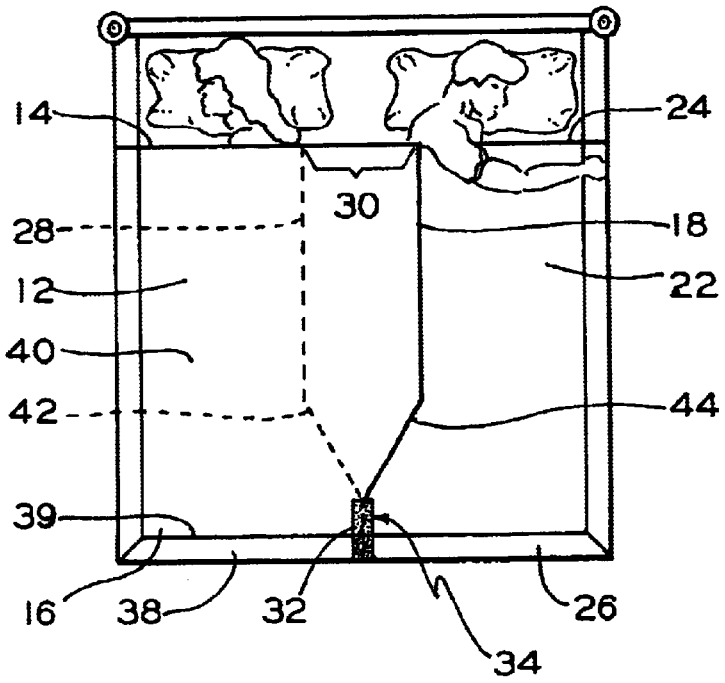
FIG. 2 shows a top plan view of the split bed covering of the invention illustrated in use.

Referring now to FIGS. 1 and 2, there is shown a top plan view of the split bed covering of the invention for more than one user, generally designated as 10, which is capable of providing different warmth characteristics to each of the users. The covering comprises a first sheet 12 having a top portion 14, a bottom portion 16, and an inner edge portion 18. The covering also includes a second sheet 22 having a top portion 24, a bottom portion 26, and an inner edge portion 28. An overlapping portion 30 is formed by the inner edge portions 18, 28 of the first and second sheets 12, 22. These inner edge portions 18, 28 are capable of being interchangeably positioned one on top of the other.

A joining means 32 is provided for joining the overlapping portion 30 at the bottom portion 16 of the first sheet 12 and the bottom portion 26 of the second sheet 22 to form a joined portion 34. The joining means 32 may be any well known permanent or temporary joining means. For example, a permanent joining means could include sewing of the sheets together. Temporary joining means could include hook and loop strips (i.e. Velcro®), snaps and the like.

The joined portion 34 has a predetermined length 36 which allows for complete removal of one of the first 12 and/or second sheets 22 from at least one of the users. The length of the joined portion 36 is such that a majority of this joined portion 34 is tucked beneath the mattress. As illustrated in FIG. 2, the joined portion may extend upward along the bottom end portion 38 of the mattress and up to substantially the meeting point 39 of the end portion 38 with the top portion 40 of the mattress. It would be undesirable for the joined portion to significantly extend over onto the top portion 40 of the mattress as such would hinder the capability of the user to completely remove the cover from themselves i.e. to allow for the user's feet to be uncovered. Also, the bed covering must have a sufficient length so that tucking of the joined portion under the mattress does not result in the bed being "short sheeted", i.e. the covering not extending sufficiently high enough to provide complete coverage to the user. Consequently, the top portions 14, 24 of the first and second sheets must comfortably cover the users. As the covering 10 is of a sufficient length, the amount of joined portion 34 which is tucked under the mattress may be readily adjusted.

The first sheet 12 and the second sheet 22 have a predetermined width and/or overlapping portion 30 so as to provide sufficient coverage to each user should one or both of the users shift while sleeping. Each of the sheets 12, 22 bow out 42, 44 after the joining section to give the users extra coverage. Since the covering 10 of the present invention is split the entire length of the portion covering the top portion 40 of the mattress, one or both of the users can readily adjust the amount of overlap by grasping the top portion 14, 24 of the covering 10 and moving it closer or farther away from an edge of the mattress.

The split bed covering of the invention enables each of the users to determine their own comfort level without affecting the other users. For example, one or both of the users can begin sleeping with their covering draped on the floor. Such would enable them to be cooler. Then as their sleep progresses, each user can easily reach down and retrieve his/her own covering. This can be done without disturbing the other occupant in the bed.

The invention has been described in such full, clear, concise and exact terms so as to enable any person skilled in the art to which it pertains to make and use the same. The split bed covering of the invention is applicable to any type of covering including sheets, bed spreads, comforters, blankets, and the like. It should be understood that variations, modifications, equivalents and substitutions for components of the specifically described embodiments of the invention may be made by those skilled in the art without departing from the spirit and scope of the invention as set forth in the appended claims. Persons who possess such skill will also recognize that the foregoing description is merely illustrative and not intended to limit any of the ensuing claims to any particular narrow interpretation.

I claim:

1. A bed covering for more than one user, said bed covering capable of providing different warmth characteristics to such users, said bed covering comprising:

(a) a first sheet having a top portion, a bottom portion, and an inner edge portion;

(b) a second sheet having a top portion, a bottom portion, and an inner edge portion;

(c) an overlapping portion formed by said inner edge portions of said first and second sheets, said inner edge portions capable of being positioned one on top of the other; and (d) a joining means for joining said overlapping portion at said bottom portion of said first sheet and said bottom portion of said second sheet to form a joined portion, said joined portion having a predetermined length which allows complete removal of one of said first and second sheets from at least one of such users and wherein said predetermined length of said joined portion has a length which is configured to extend from beneath a mattress up over a first end portion of said mattress and stopping substantially at a meeting point of said first end portion of said mattress and a top portion of said mattress and wherein said top portion of each of said first and second sheet is configured to extend substantially to an oppositely disposed second end portion of said mattress.

2. A bed covering as recited in claim 1 wherein said first inner edge portion and said second inner edge portion are capable of being interchangeably positioned one on top of the other.

3. A bed covering as recited in claim 1 wherein said first and second sheets have a predetermined width which enables sufficient coverage of each of such users.

4. A bed covering as recited in claim 3 wherein an amount of coverage of one of said first and second sheets may be readily adjusted by grasping said top portion of one of said first and second sheets and moving one of said first and second sheets toward and/or away from an edge portion of a mattress.

5. A bed covering as recited in claim 1 wherein each of said first and second sheets include a bowed portion which extends from said joined portion.

6. A bed covering as recited in claim 1 wherein said top portion of said first sheet and said top portion of said second sheet are capable of comfortably covering such users.

7. A bed covering as recited in claim 1 wherein said joining means comprises a permanent joining means.

8. A bed covering as recited in claim 7 wherein said permanent joining means comprises a sewn portion.

9. A bed covering as recited in claim 1 wherein said joining means comprises a temporary joining means.

10. A bed covering as recited in claim 9 wherein said temporary joining means comprises one of snaps and hook and loop strips.

11. A bed covering for more than one user in combination with a mattress, said mattress comprising a first end portion, an oppositely disposed second end portion, and a top portion, said bed covering capable of providing different warmth characteristics to such users, said bed covering comprising:

(a) a first sheet having a top portion, a bottom portion, and an inner edge portion;

(b) a second sheet having a top portion, a bottom portion, and an inner edge portion;

(c) an overlapping portion formed by said inner edge portions of said first and second sheets, said inner edge portions capable off being positioned one on top of the other; and (d) a joining means for joining said overlapping portion at said bottom portion of said first sheet and said bottom portion of said second sheet to form a joined portion, said joined portion having a predetermined length which allows complete removal of one of said first and second sheets from at least one of such users and wherein said predetermined length of said joined portion has a length which is configured to extend from beneath a mattress up over said first end portion of said mattress and stopping substantially at a meeting point of said first end portion of said mattress and a top portion of said mattress.

12. A bed covering in combination with a mattress as recited in claim 11 wherein said top portion of each of said first and second sheet extends substantially to said oppositely disposed second end portion of said mattress.

13. A bed covering in combination with a mattress as recited in claim 11 wherein said first inner edge portion and said second inner edge portion are capable of being interchangeably positioned one on top of the other.

14. A bed covering in combination with a mattress as recited in claim 11 wherein said first and second sheets have a predetermined width which enables sufficient coverage of each of such users.

15. A bed covering in combination with a mattress as recited in claim 14 wherein an amount of coverage of one of said first and second sheets may be readily adjusted by grasping said top portion of one of said first and second sheets and moving one of said first and second sheets toward and/or away from an edge portion of a mattress.

16. A bed covering in combination with a mattress as recited in claim 11 therein each of said first and second sheets include a bowed portion which extends from said joined portion.

17. A bed covering in combination with a mattress as recited in claim 11 wherein said top portion of said first sheet and said top portion of said second sheet are capable of comfortably covering such users.

18. A bed covering in combination with a mattress as recited in claim 11 wherein said joining means comprises a permanent joining means such as a sewn portion.

19. A bed covering in combination with a mattress as recited in claim 11 wherein said joining means comprises a temporary joining means such as one of snaps and hook and loop strips.

* * * * *